United States Patent [19]

Brown et al.

[11] 4,005,946

[45] Feb. 1, 1977

[54] METHOD AND APPARATUS FOR CONTROLLING STATOR THERMAL GROWTH

[75] Inventors: Bertrand Hirsch Brown, Glastonbury; Francis Louis DeTolla, Vernon; Dale Robert Reilly, Marlborough, all of Conn.

[73] Assignee: United Technologies Corporation, Hartford, Conn.

[22] Filed: June 20, 1975

[21] Appl. No.: 588,916

[52] U.S. Cl. ..... 415/136; 415/178

[51] Int. Cl.[2] ..... F01D 25/24

[58] Field of Search ..... 415/116, 178, 136, 12, 415/39

[56] References Cited

UNITED STATES PATENTS

| | | | |
|---|---|---|---|
| 2,787,440 | 4/1957 | Thompson, Jr. | 415/116 |
| 2,962,256 | 11/1960 | Bishop | 415/116 |
| 3,690,785 | 9/1972 | Lind | 415/178 |
| 3,736,069 | 5/1973 | Beam, Jr. et al. | 415/178 |
| 3,807,891 | 4/1974 | McDow et al. | 415/116 |
| 3,814,313 | 6/1974 | Beam et al. | 415/115 |
| 3,966,354 | 6/1976 | Patterson | 415/116 |

*Primary Examiner*—Henry F. Raduazo
*Attorney, Agent, or Firm*—Robert C. Walker

[57] ABSTRACT

Methods and apparatus for controlling the radial clearance between the rotor and stator elements in the turbine section of a gas turbine engine is disclosed. A cooling air valve is operatively disposed at the upstream end of the turbine section to control the admission of cooling air to the turbine in response to engine operating temperatures. In one specific embodiment the thermal growth of the case and the stator elements supported thereby is controlled by the valve. At low power conditions the case and the supported elements grow radially with the rotor in response to increasing gas path temperatures. At elevated conditions cooling air is flowable to the case to retard the thermal growth of the case and allow the rotor to grow radially toward the stator elements.

4 Claims, 8 Drawing Figures

METHOD AND APPARATUS FOR CONTROLLING STATOR THERMAL GROWTH

BACKGROUND OF THE INVENTION

1. Field of the Invention

This invention relates to gas turbine engines and more particularly to apparatus for controlling the flow of cooling air to the turbine section during operation of the engine.

2. Description of the Prior Art

In a gas turbine engine of the type referred to above, pressurized air and fuel are burned in a combustion chamber to add thermal energy to the gases flowing therethrough. The effluent from the chamber comprises the working medium gases and is flowed axially downstream in an annular flow path through the turbine section of the engine. A first row of nozzle guide vanes at the inlet to the turbine directs the medium gases onto a row of blades which extends radially outward from the engine rotor. An annular shroud which is supported by the turbine case surrounds the tips of the blades to minimize the leakage of working medium gases across the blade tips. In many engines the shroud is segmented and is positioned with respect to the blade tips by the turbine case.

The turbine blades are sensitive to the temperature of the medium gases flowing thereacross. As the gas temperatures increase, the blades instantaneously respond by expanding in the span-wise direction radially outward toward the shroud. The turbine case, which supports the shroud, however, is isolated from the medium gases in the flow path and is much slower to respond to the changing flow path conditions. Substantial clearance between the blade tips and the shroud is provided in the cold condition to prevent the destructive impact of the blades on the shroud as the engine is accelerated and the flow path temperatures increase. Before thermally stable conditions are reached the turbine case and the shroud supported therefrom grow radially away from the blade tips leaving again a substantial clearance which approximates the clearance in the cold condition. In order to reduce the clearance at thermally stable conditions, including maximum power and cruise, recent constructions have provided cooling air along the turbine case. Cooling the turbine case diminishes the growth of the case away from the fully expanded blades as thermal equilibrium is reached. Accordingly, the equilibrium diameter of the shroud more closely matches the diameter circumscribed by the rotating blades and the clearance is reduced.

The term "pinch point" is defined as the condition of closest proximity between the blade tips and the surrounding shroud. The clearance at the pinch point is generally positive, although in some constructions a moderate interference fit between the shroud and the passing blade tips is allowed. As is demonstrably illustrated in FIG. 7 graph, the interference or clearance is set at the pinch point by increasing or decreasing the magnitude of the initial clearance to adjust the appropriate shroud curve upward or downward. The more closely the shroud radius is tailored to the blade tip radius the smaller the magnitude of the clearance at thermally stable conditions becomes.

Apparatus for controlling the flow of turbine cooling air to achieve an optimum relationship between the clearance at stable conditions and adequate pinch point clearance comprises a significant portion of the inventive concepts disclosed and is discussed later herein. In some constructions having apparatus which is apparently similar to that of the present invention, the quantity of air flowing to the turbine vanes is controlled by a thermally responding valve. In U.S. Pat. No. 3,736,069 to Beam et al entitled "Turbine Stator Cooling Control," an annular ring having a comparatively high coefficient of thermal expansion is disposed radially outward but in intimate contact with the structure supporting the turbine vanes. As the turbine temperatures increase during the operation of the engine, the annular ring grows radially outward at a rate exceeding that of the vane supporting structure. A radial gap opens between the ring and the supporting structure to provide a path for cooling air which is then flowable through the gap to the turbine vanes.

Although the device of Beam et al appears suitable for use in controlling the flow of cooling air to the turbine case, the apparent immediate response to the valve to increasing temperatures limits its effectiveness for case temperature control.

SUMMARY OF THE INVENTION

A primary object of the present invention is to minimize the radial clearance between the rotor of a gas turbine engine and the rotor surrounding elements of the stator. Another object of the present invention is to improve the performance and durability of the turbine through the judicious use of cooling air.

According to the present invention stator elements surrounding the rotor of a gas turbine engine are radially positioned according to the diameter of the turbine case which is thermally responsive to the flow of cooling air along the case, the air being flowable through a control valve upon the attainment of a threshold temperature.

A primary feature of the present invention is the thermally responsive cooling air valve which opens to admit cooling air to the turbine section of the engine only upon the attainment of a threshold operating temperature. In one embodiment a deflecting ring which is fabricated from a material having a relatively high coefficient of thermal expansion is disposed radially outward of a base ring which is fabricated from a material having a relatively low coefficient of thermal expansion. In the cold condition the rings are in intimate contact having an interference fit therebetween. In an alternate embodiment the base and deflecting rings have substantially equivalent coefficients of thermal expansion and a control ring, which is disposed radially outward of the base ring, is fabricated from a material having a relatively low coefficient of thermal expansion. The control ring has the freedom to move radially inward with respect to the base ring until contacting the base ring, whereupon the control ring drives the base ring apart from the deflecting ring in response to further increasing temperatures.

A principal advantage of the present invention is the minimized clearance between the rotor and the rotor surrounding elements of the stator. A further advantage of the present invention is the ability of the apparatus to terminate the flow of cooling air into the turbine at thermal conditions below a threshold temperature.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
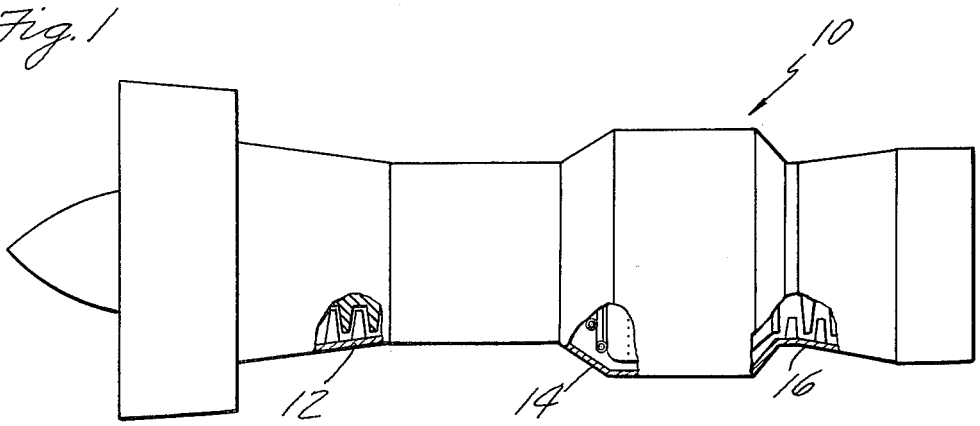
FIG. 1 is a simplified side elevation view of a typical gas turbine engine showing the relative locations of the major engine components.
Figure 2:
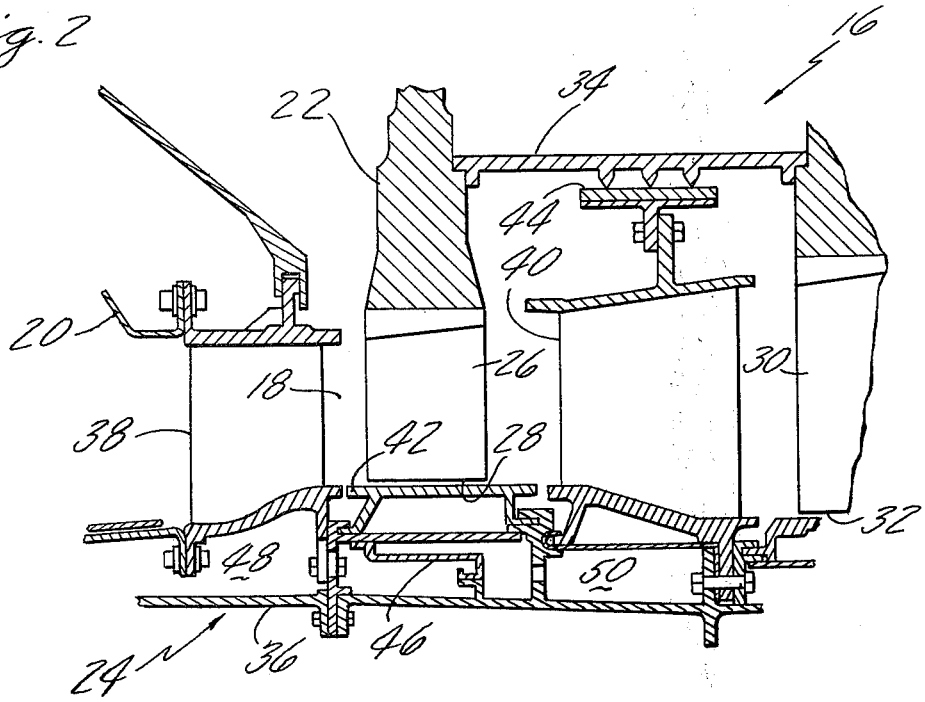
FIG. 2 is a partial cross section view showing a portion of the turbine section of the engine of FIG. 1.

A gas turbine engine 10 is shown in a typical configuration in FIG. 1. A compressor section 12 is positioned axially upstream of a combustion section 14 and a turbine section 16 is positioned axially downstream of the combustion section. An enlarged cross section view of the portion of the turbine section is shown in FIG. 2. A flow path 18 for the working medium gases which are discharged from the combustor 20 extends axially through the turbine section. The turbine section has a rotor 22 and a stator 24. The rotor 22 includes a row of first blades 26 each having a tip 28 and a row of second blades 30 each having a tip 32. The rotor further includes a labyrinth seal 34 positioned between the rows of blades. The stator 24 has a case 36 and includes a row of first vanes 38 extending radially inward from the case and a row of second vanes 40 extending radially inward from the case. A shroud 42 extends axially between the rows of vanes and radially surrounds the tips 28 of the first blades 26. A labyrinth seal land 44, which is attached to the inward ends of the second vanes 40, radially surrounds the labyrinth seal 34. Both the shroud 42 and the seal land 44 are segmented to reduce thermal stresses. An air control valve 46, which is thermally responding, is disposed between an upstream conduit 48 and a downstream conduit 50. Both conduits are substantially annular and run adjacent to the case 36.

Figure 3:
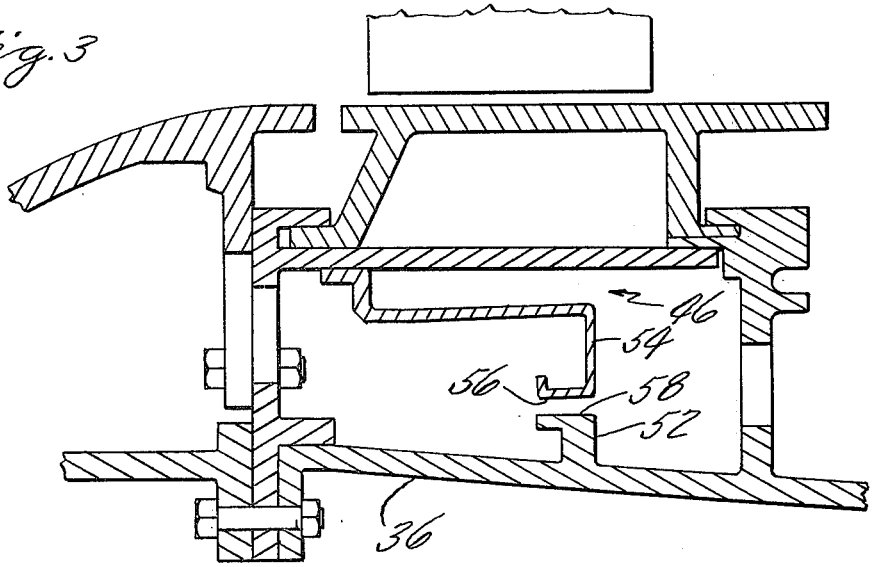
FIG. 3 is an enlarged partial cross section view showing a first preferred cooling air valve in the open position.

Referring to FIG. 3, the control valve 46 comprises a deflecting ring 52 which is integrally formed with the case 36 as shown and a base ring 54. The base ring has an outwardly facing surface 56 which radially opposes an inwardly facing surface 58 of the deflecting ring.

Figure 4:
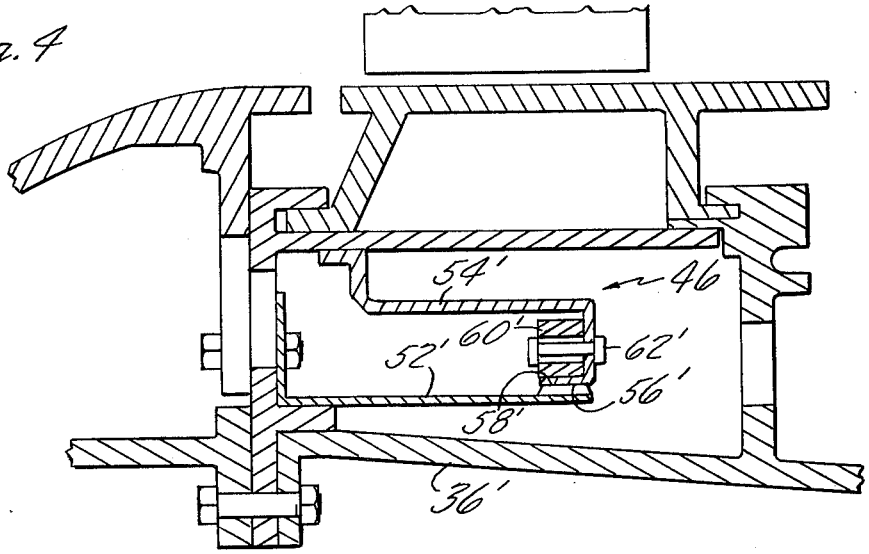
FIG. 4 is an enlarged partial cross section view showing a second preferred cooling air valve in the fully closed position.

In an alternate embodiment which is shown in FIG. 4, the deflecting ring 52' is a member formed separately from the case 36'. A control ring 60' is attached to the base ring 54' by a rivet 62'. The base ring 54' has an outwardly facing surface 56' which radially opposes an inwardly facing surface 58' of the deflecting ring 52'.

During operation of the engine pressurized air from the compressor 12 and fuel are burned in a combustor 20 to add thermal energy to the gases flowing through the engine. The effluent from the combustor comprises the working medium gases and is discharged into the flow path 18 in the turbine section of the engine. The blades and vanes of the turbine section are directly exposed to the working medium gases and are highly sensitive to variations in the gas temperature. The turbine case 36 is remotely located from the flow path 18 and is, accordingly, much less sensitive to variations in the gas temperature.

As the engine is accelerated from idle, the gas temperatures increase causing a nearly instantaneous thermal expansion of the blades and vanes in the spanwise direction. Specifically the tips 28 of the first row of blades 36 are displaced radially outward in the direction of the shroud 42. The condition of closest proximity between the blade tips 28 and the shroud 22 occurs upon acceleration and is referred to as the pinch point. The pinch point is discussed in the prior art section of this specification and is illustrated by the FIG. 7 graph.

Figure 7:
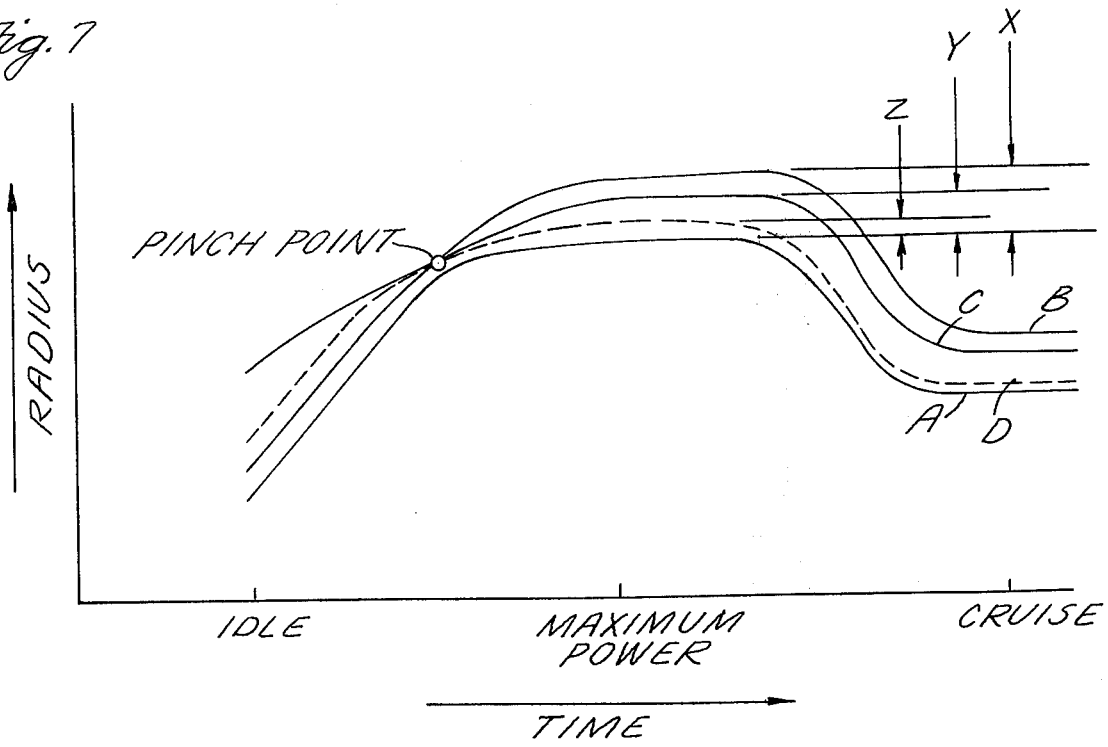
FIG. 7 is a graph showing the radial growth of the rotor blade tips and the surrounding shroud during the thermal transition between engine idle and steady state, maximum power conditions.

Line A of the FIG. 7 graph represents the radial position of the rotor blade tips 28 which are displaced sharply in the outward direction as the engine is accelerated. Line B of the FIG. 7 graph represents the radial position of a blade tip shroud which is supported from an uncooled case. The shroud is displaced radially outward at a much slower initial rate than the tips 28 and when thermally stable conditions are reached a clearance between the tip 28 and the shroud obtains which is represented by the distance X. Line C represents a blade tip shroud which is supported from a continuously cooled case. The rate of response as shown by line C is slower than that shown by line B for the uncooled case; however, the clearance Y at equilibrium is less than the clearance in the uncooled construction. The shroud 42 of the present invention is supported from a case which is cooled only upon the attainment of a threshold temperature. Line D represents the radial position of the shroud 42 in the present construction. The initial rate of response approximates that of the uncooled case until the cooling air valve is opened and air is flowed to the case retarding the rate of case thermal expansion. The steady state clearance at maximum power for the shroud 42 of the present construction is represented by the distance Z.

Relatively cool air from the compressor section 12 flows through the upstream conduit 48, bypasses the combustor and is flowable through the downstream conduit 50 upon the opening of the thermally responding valve 46. The valve 46 is shown in the closed position in FIG. 2. In the closed position, which is as installed, the outwardly facing surface 56 of the base ring 54 is in intimate contact with the inwardly facing surface 58 of the deflecting ring 52. The coefficient of thermal expansion of the material from which the base ring is fabricated is less than the coefficient of thermal expansion of the material from which the case and deflecting ring are fabricated. As the engine is accelerated the deflecting ring tends to grow away from the base ring to the open position shown in FIG. 3 in response to increasing temperatures. Once the rings have parted, cooling air is flowable therebetween to cool the case and limit the magnitude of the case thermal growth.

Figure 8:
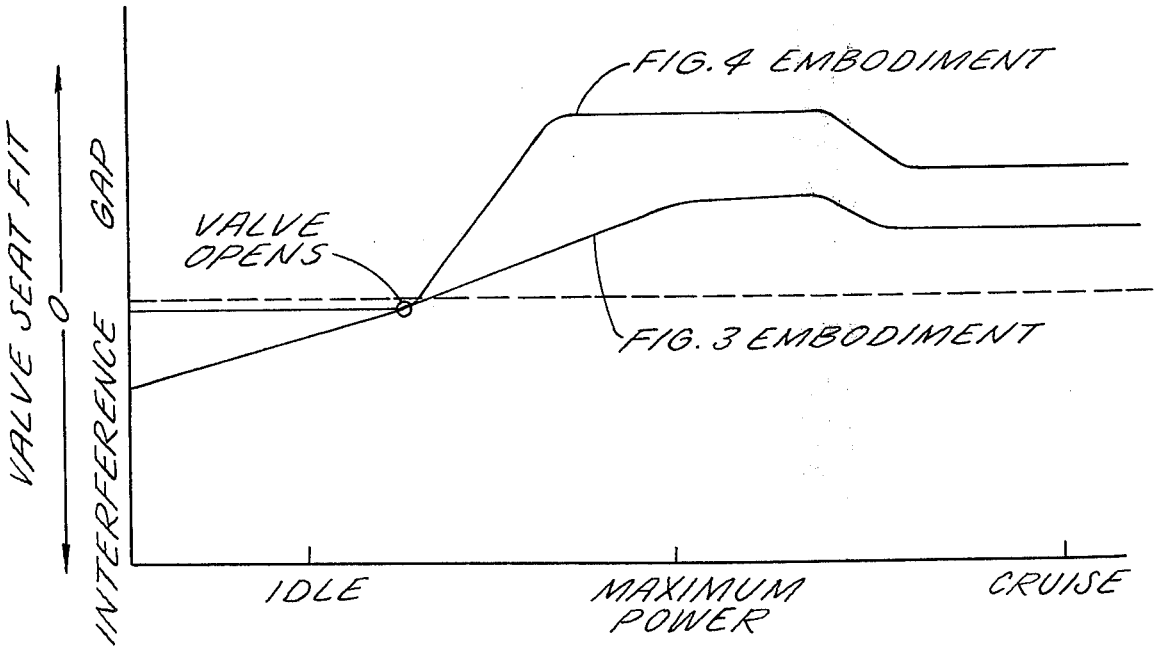
FIG. 8 is a graph showing the fit between the base ring and deflecting ring of the air control valves shown in the FIGS. 3 and 4 embodiments during the thermal transition between engine idle and steady state maximum power conditions.

An interference fit is provided between the outwardly facing surface 58 of the base ring 54 and the inwardly facing surface 58 of the deflecting ring 52. Accordingly the two rings do not part until a threshold temperature is reached. The threshold temperature is individualized for each engine model so that the case cooling air becomes flowable at an optimum point which in most constructions occurs just just before the pinch point. The relationship between fit and temperature is shown in the FIG. 8 graph which is representative of materials having a substantially uniform coefficient of thermal expansion over the engine temperature range. In the cold condition an interference fit is shown. At somewhat above the idle condition the rings part to provide an increasingly wide gap. An increased amount of interference fit increases the threshold temperature at which the rings part.

Figure 5:
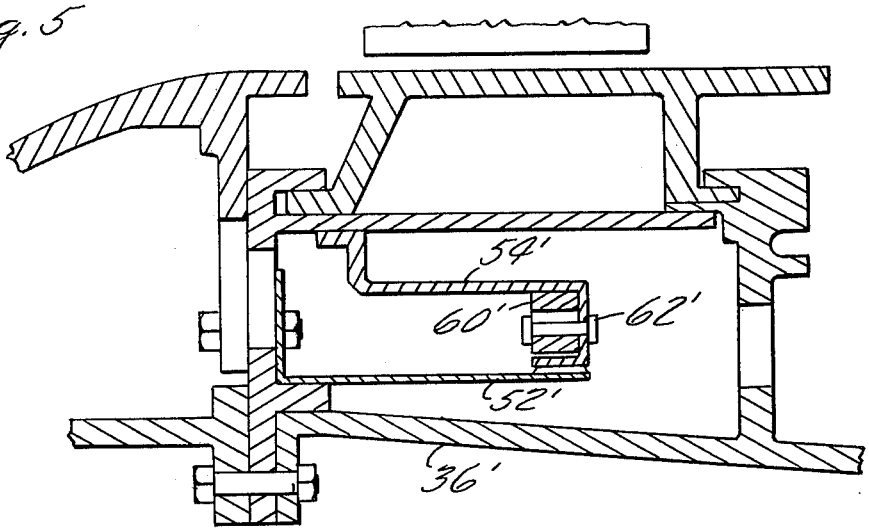
FIG. 5 is an enlarged partial cross section view showing the valve of FIG. 4 in a thermal environment just below the threshold temperature.
Figure 6:
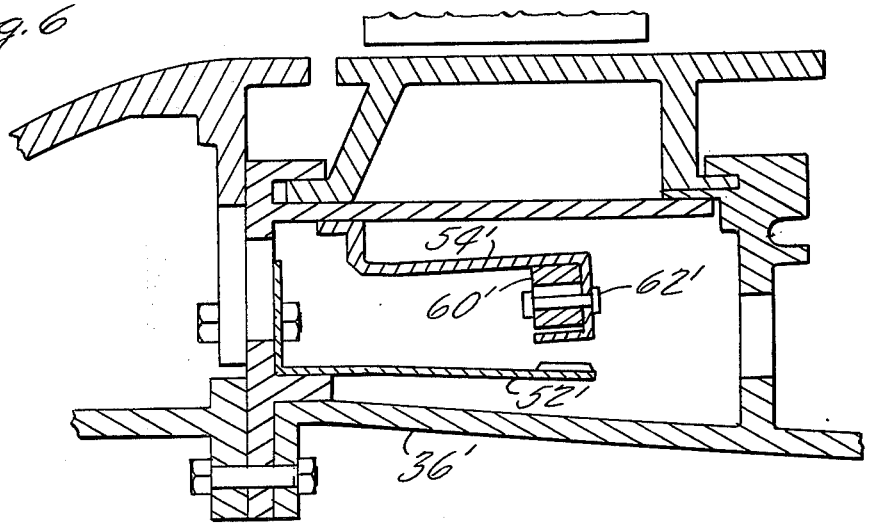
FIG. 6 is an enlarged partial cross section view showing the valve of FIG. 4 in a thermal environment above the threshold temperature.

Referring to FIG. 4, an alternate construction of the cooling air valve 46 is shown in the fully closed position. The base ring 54' and the deflecting ring 52' are fabricated from materials having substantially similar high coefficients of thermal expansion. The control ring 60' is fabricated from a material having a relatively low coefficient of thermal expansion. As the engine is accelerated the base ring 54' and the deflecting ring 52' grow radially outward with respect to the case 36 while the control ring 60' grows radially inward with respect to the case to the position shown in FIG. 5. At slightly above the idle condition the control ring 60', which now radially abuts the base ring 54', drives the base ring radially inward away from the deflecting ring 52'. The described action is graphically displayed in FIG. 8 where it can be seen that a gap between the base and deflecting rings opens sharply at a point above the idle condition. Although the valve of the FIG. 4 embodiment is somewhat more complex than the valve of the FIG. 3 embodiment, the FIG. 4 valve is particularly advantageous where a substantial opening delay to the threshold temperature is required. Furthermore, the FIG. 4 valve may be designed to open more crisply and to a wider gap than the corresponding FIG. 3 valve. Nevertheless, both valves represent typical embodiments of the invention which are useful in controlling the radial clearances between the rotor and the rotor surrounding elements of the stator.

Although the above discussion is directed to the blade tips and the corresponding shroud, the concepts are equally applicable to clearances at the inner diameter of the flow path 18. For example, the radial clearance between the labyrinth seal 34 and the labyrinth seal land 44 is also minimized by the same retardation of the case thermal growth which occurs in response to the opening of the valve 46.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. In a gas turbine engine having a rotor and a stator having elements which radially surrounds the rotor, apparatus for controlling the radial clearance between the rotor and the stator, including:

a turbine case which is coolable and which supports said elements of the stator which radially oppose the rotor; and an air valve operatively disposed with respect to said case to control the flow of cooling air adjacent thereto, said valve comprising a deflecting ring which is directly affixed to said turbine case, and a base ring supported by said elements which is spaced radially inward of said deflecting ring and is in interference contact with said base ring, wherein the base ring is fabricated from a material having a coefficient of thermal expansion which is less than the coefficient of thermal expansion of the material from which the deflecting ring is fabricated such that the base ring and deflecting ring are separable in operative response to the attainment of a predetermined threshold temperature allowing cooling air to flow between said rings.

2. The invention according to claim 1 wherein the magnitude of said interference is sized to provide separation of the deflecting ring from the base ring at a threshold temperature which corresponds to an engine operating condition above idle.

3. In a gas turbine engine having a rotor and a stator having elements which radially surrounds the rotor, apparatus for controlling the radial clearance between the rotor and the stator, including:

a turbine case which is coolable and which supports the elements of the stator which radially oppose the rotor; and an air valve operatively disposed with respect to said case to control the flow of cooling air adjacent thereto, said valve comprising, a deflecting ring which is directly affixed to said turbine case, a base ring supported by said elements which is spaced radially inward of said deflecting ring and is in intimate contact with said base ring, and a control ring which is slideably attached to the base ring in a manner permitting the base ring to grow radially outward with respect to the control ring in a thermal environment below a threshold temperature only, wherein said control ring is fabricated from a material having a lesser coefficient of thermal expansion than the material from which the deflecting ring is fabricated, the initial clearances between said base ring, deflecting ring, and control ring being sized so as to provide separation between said base ring and said deflecting ring at the threshold temperature.

4. The invention according to claim 3 wherein the relative coefficients of thermal expansion of the initial clearances of the base ring, the deflecting ring and the control ring provide separation of the base and deflecting rings at a threshold temperature which corresponds to an engine operating condition above idle.

* * * * *